United States Patent [19]

Graham, Jr. et al.

[11] Patent Number: 4,541,231

[45] Date of Patent: Sep. 17, 1985

[54] PROCESS FOR REINFORCED YARN WITH GLASS FIBER CORE

[75] Inventors: Clarence O. Graham, Jr., New Orleans; Charles L. Shepard, Chalmette; George F. Ruppenicker, Jr., Kenner; Russell M. H. Kullman, Harahan, all of La.

[73] Assignee: The United States of America as represented by the Secretary of Agriculture, Washington, D.C.

[21] Appl. No.: 526,751

[22] Filed: Aug. 26, 1983

[51] Int. Cl.[4] ..... D02G 3/16; D02G 3/28

[52] U.S. Cl. ..... 57/12; 57/14; 57/229; 57/240; 57/315

[58] Field of Search ..... 57/3, 6, 12, 229, 240, 57/249, 315, 14

[56] References Cited

U.S. PATENT DOCUMENTS

| | | | |
|---|---|---|---|
| 2,859,583 | 11/1958 | Parker | 57/12 |
| 3,029,953 | 6/1963 | Blackstock | 57/12 |
| 3,375,655 | 4/1968 | Swales | 57/238 X |
| 3,729,920 | 5/1973 | Sayers et al. | 57/229 X |
| 3,739,566 | 6/1973 | Smith | 57/315 X |

*Primary Examiner*—Donald Watkins

*Attorney, Agent, or Firm*—M. Howard Silverstein; David G. McConnell; Raymond C. Von Bodungen

[57] ABSTRACT

A unique process for producing torque-free or balanced yarns of staple fibers with glass filament cores is disclosed. Staple fiber roving is fed through a drafting system. Glass filament is fed into the center of the staple fiber just prior to entering the front rolls of the drafting system. Sufficient twist is applied to the fiber around the glass filament using the ring spinning process and two or more of these yarns are ply twisted in the opposite direction of the spinning direction to firmly lock the staple fiber to the glass filament. The twist multiplier range for spinning is between 3.0 to 3.5 and for plying is betwen 3.5 and 4.5. Cotton fiber is the principle fiber used with a glass filament core. The resulting yarn can be tied by knotting onto existing loom beam ends when breaks occur during weaving without shearing of the yarns.

9 Claims, 1 Drawing Figure

PROCESS FOR REINFORCED YARN WITH GLASS FIBER CORE

BACKGROUND OF THE INVENTION (1) Field of the Invention

This invention relates to processes for making textile yarns. More particularly, it relates to processes using glass fiber cores as reinforcement in the spinning of staple fibers to produce yarns that may be knotted.

(b 2) Description of the Prior Art

It is well known that fiber and filament of glass are resistant to degradation from sunlight, mold and mildew. They are stronger than most other natural and manmade fibers, have a higher degree of resistance to flammability, and are generally chemically inert. Stiffness, shearability and surface smoothness manifested in slickness and poor adhesion of fiber sheaths demand extreme handling care and have limited the scope of glass filament in textile applications. It is also well known that too much twist makes yarns of glass filament unruly and difficult to process and may result in shearing.

The prior art references patents relating to sizing agents for glass yarns.

Industrial publications describe yarn handling procedures for glass fiber yarn, including splicing techniques and fluids such as cellulose acetate to glue glass fiber yarns in splicing. All known yarns containing glass fiber yarn require a chemical coating or size application prior to weaving and are subject to problems associated with glass fiber handling.

Researchers have tried various techniques to marry staple fibers with glass fiber and filament in producing a yarn but none have been successful in overcoming the skinning back of the sheath of surface fibers due to the slick surface of the glass while simultaneously eliminating the need for slashing, the need for splicing rather than conventional tieing and avoiding unruliness through low torque. For those skilled in the art, splicing is routinely employed for glass containing yarns as tieing is known to shear such yarns.

SUMMARY OF THE INVENTION

This invention relates to a yarn making process for textiles, and more particularly to the use of glass filament cores as reinforcement in the spinning of staple fibers to give yarns that may be easily tied with weaver and other type knots and on an automatic tieing-in machine and woven without slashing; fabrics produced therefrom will have characteristics of the staple fiber sheath.

It is an object of this invention to provide a process in the making of low torque glass fiber core reinforced yarns useful in knitting and weaving.

We have now found that a relatively torque-free yarn reinforced with a glass fiber core can be produced utilizing a single twist multiplier in the range of 3.0 to 3.5 with "S" twist and subsequently ply twisting with "Z" twist. The plying firmly locks the staple fiber wrap to the smooth filament glass core surface. The yarns may easily be knotted together using conventional tieing-in machinery and used as warp without sizing agents to weave fabrics. Fabrics produced from these yarns are stronger than those made from the staple yarn only and yet have the surface characteristic of the staple fiber.

The process comprises the following steps: (a) feeding staple fiber roving through a drafting system to form a drafted strand of staple fiber; (b) feeding a glass filament yarn to the front rolls of the drafting system and placing the filament in the center of the drafted strand of staple fiber just prior to entering the front rolls of the drafting system; (c) spinning the staple fiber around the glass filament core with sufficient twist to assure proper adhesion of fiber to filament (d) ply twisting two or more single yarns in the opposite direction from the spinning direction to firmly lock the staple fiber wrap to the smooth filament glass core and thus produce a torque-free or balanced yarn that can be knotted.

DESCRIPTION OF THE PREFERRED EMBODIMENTS

Figure 1:
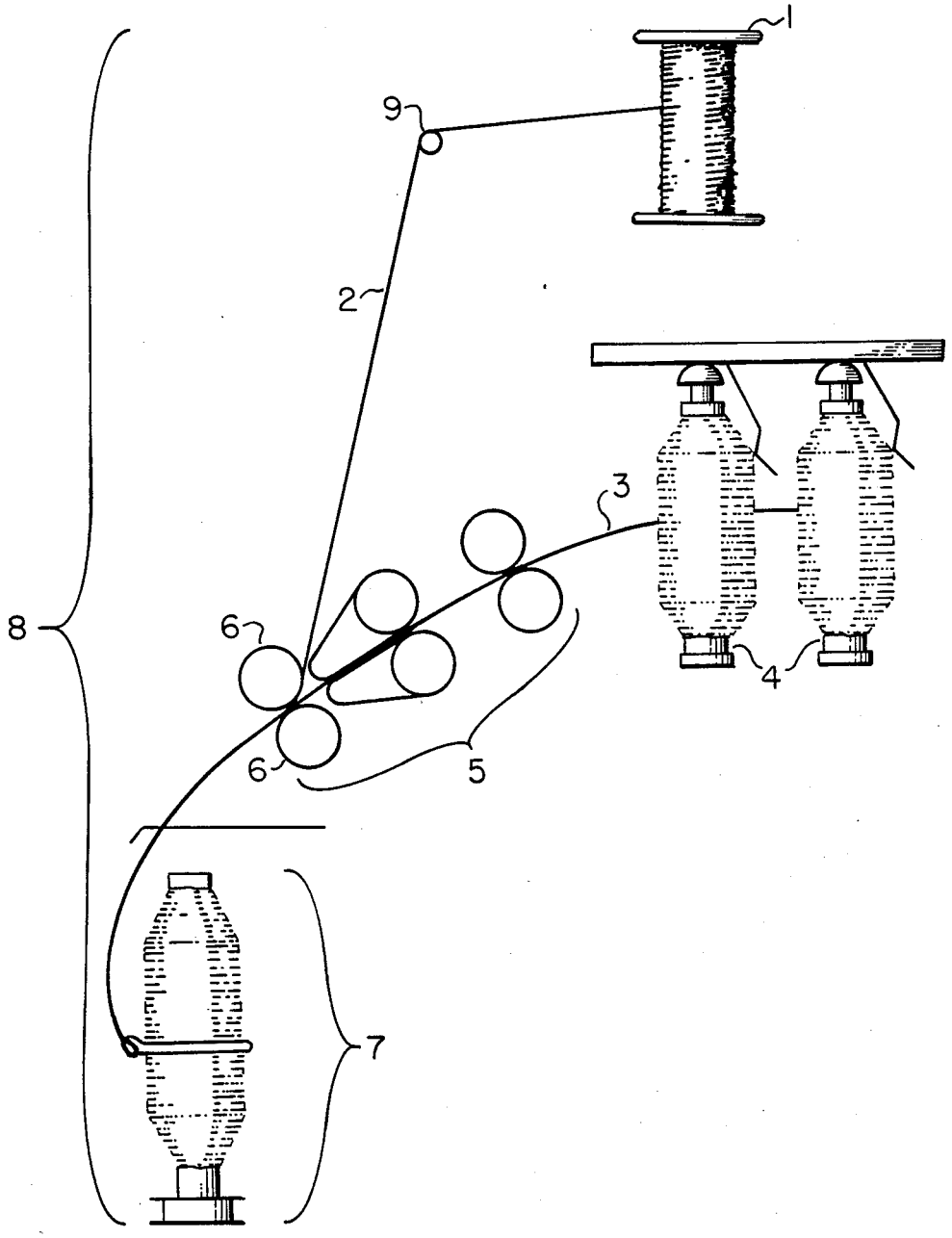
FIG. 1 is a pictorial illustration of the principal parts of an apparatus for producing a single core yarn with a staple fiber wrapping using a modified ring spinning frame.

In general, this invention provides a process for producing a unique yarn with glass fiber cores and a staple fiber sheath that is relatively torque-free and balanced in the plied state and can be woven without slashing.

The glass filament yarn cores employed with the staple fiber are selected from any number of those commercially available with the preferred grade being electrical and ranging in the yarn from about 20% to 50% in weight.

Staple fibers suitable for this invention include natural and manmade fibers. It is also within the scope of this invention to employ blends of natural fibers, blends of manmade fibers, and blends of natural and manmade fibers as the sheath for the glass core. Preferred fibers are cotton and cotton blends. Because of the greater density of glass compared to cotton (cotton has a density of 1.5 compared to about 2.5 for glass) the glass reinforced yarns with a cotton sheath tend to be smaller in diameter than comparable counts of 100% cotton. Additional cotton and blends thereof with other fibers of lower density than glass may be added to increase overall diameter. Composition of the yarns may be varied with a minimum of 40% as staple fiber.

The preferred form of fabric for the unique yarns produced in the process of this invention is in the woven state but textile material may be in other forms such as knit.

A conventional ring spinning frame with a double apron drafting system was modified to accommodate spools and bobbins of glass filament yarn. Staple fiber roving is fed in the normal way through the drafting system. Glass filament yarn is fed directly from the spool or bobbin to the front rolls of the drafting system through a porcelain guide that places the filament in the center of the drafted strand of staple fiber. It is within the scope of this invention to use two or more strands of an equivalent percentage of the total weight of a single roving. Spinning frames may be equipped with or without a drafting system fiber condenser.

Producing a single staple/glass core yarn on a ring spinning frame as used in this invention is extremely critical because the glass fiber is stiff, resists twist, and shears easily. Too much twist causes yarns to be unruly and difficult to handle, and too little twist results in poor adhesion of the staple fiber wrapping to the filament core. Twist multipliers of from about 2.5 to about 4.0 may be used with a preferred range of 3.0 to 3.5 to achieve minimum twist for adhesion of staple fiber while avoiding unruliness and shearing. It is within the scope of the invention to employ a pretwisted glass filament core to reduce torque in the resultant core yarn, in such case, the pretwisted filament must be rolled off a spool rather than pulled over the end of a bobbin. Singles yarns by the spinning process are then ply-twisted in the opposite direction from the singles twist to produce a balanced plied yarn with each singles component having a glass core. Twist multipliers in the range of about 3.5 to 4.5 are preferred in the plying step.

While the "S" direction during the spinning and "Z" direction during plying are preferred; it is within the scope of this invention to reverse these directions.

FIG. 1 is a diagram of the process used to produce the staple fiber glass filament single core yarn. It consists of a ring spinning frame 8 with a double apron drafting system 5, modified to accommodate spools 1 of glass filament 2. The spools 1 are mounted on special bearing surfaces in such a way that constant tension is maintained on glass filament yarn 2. Spinning frame 8 is equipped to hold one or more bobbins of roving 4 for each drafting unit. Staple fibers 3 in the form of roving on bobbins 4 are fed through double apron drafting system 5 to front rolls 6 to form a strand of staple fibers. Glass filament yarn 2 is fed directly to the back of front drafting rolls 6 through porcelain guide 9 and into the center of the drafted strand of staple fiber. After passing through front rolls 6 staple fiber is spun around the glass filament core 2 with sufficient twist to assure proper adhesion of fiber to filament by means of ring spinning apparatus 7. There is a critical range of twist multiplier. The lower parameter of twist multiplier is 3.0 for proper adhesion of staple fibers to filament glass core. Below 3.0 the staple fibers will not adhere to the filament core. Above 3.5 yarn torque causes unruly yarn and the individual glass filaments tend to shear.

Not shown by FIG. 1 is the additional step of ply twisting two or more single yarns in the opposite direction from the spinning direction to firmly lock the staple fiber wrap to the smooth filament glass core and thus produce a torque free or balanced yarn.

The following examples further describe the invention and are given as illustrations and should not be considered as limiting in scope.

EXAMPLE 1

Double creeled 1.5 hank roving of cotton was mounted on a ring spinning frame and fed in the normal way through the drafting system using a draft of about 39. A spool of 100 denier glass filament, electrical grade, with 4 turns/inch of "Z" twist was mounted behind the drafting unit of the spinning frame. The filament was fed directly from the spool to the front rolls of the drafting system through a porcelain guide that placed the filament in the center of the drafted strand of staple fiber. Yarn spun from this process had an actual cotton count of 18.9/1 but the yarn diameter was equivalent of a 22/1 yarn spun from 100% cotton.

A twist multiplier of 3.35 (15.7 turns/in of "S" twist) was used to spin the single core yarn. Experience has shown that a twist multiplier range of about 3 to 3.5 can be used. The nominal 22/1 spun yarn with the glass filament core was ply-twisted with 13.6 turns/inch of "Z" twist to produce a nominal 22/2 yarn that contained approximately 36% glass and 64% cotton.

A 22/2 yarn of 100% cotton following the same procedure but without the glass filament was prepared by spinning and plying.

Knot strength determinations are shown in the following table.

| Nominal Yarn No. | Fiber Composition | Knot Strength, lbs |
|---|---|---|
| 22/2 | 100% Cotton | 1.45 |
| 22/2 | 64% Cotton/36% Glass* | 1.70 |

*100 denier glass filament core in each ply.

These results were totally unexpected as the yarn with glass fiber actually had higher knot strength than the cotton yarn.

EXAMPLE 2

A range of glass filament core reinforced cotton yarns of nominal 11/1 and 20/1 cotton count were spun by the process of Example 1 to produce constant diameters based on the respective diameters of equivalent 100% cotton yarns. Results are listed in the following table.

| Glass Filament Core (denier) | Nominal Yarn Count[1] 11/1 Glass Fiber % | 11/1 Actual Count | 20/1 Glass Fiber % | 20/1 Actual Count |
|---|---|---|---|---|
| 50 | — | — | 17 | 18.6 |
| 100 | 19 | 10.2 | 33 | 17.4 |
| 198 | 35 | 9.5 | 57 | 15.4 |
| 298 | 50 | 8.8 | — | — |

[1]Yarn linear density increased as the percentage of glass fiber was increased. The results demonstrate an effective range of yarns that may be spun by the process of this invention.

EXAMPLE 3

Double creeled 1.5 hank roving of cotton was mounted on the ring spinning frame and fed in the normal way through the drafting system. A draft of about 35 was used. A spool of 100 denier glass filament, electrical grade, with 4 turns/inch of "Z" twist was mounted behind the drafting unit of the spinning frame. The filament was fed directly from the spool to the front roll of the drafting system through a porcelain guide that placed the filament in the center of the drafted strand of staple fiber. A twist multiplier of 3.35 (15 turns/inch of "S" twist) was used to spin the single core yarn. Yarn spun from the process had an actual cotton count of 17.4/1 but the yarn diameter was equivalent to that of a 20/1 yarn spun from 100% cotton. The nominal 20/1 ring spun cotton yarn with the glass filament core was ply twisted with 13 turns/inch of "Z" twist to produce a nominal 20/2 yarn that contained approximately 33% glass and 67% staple cotton fiber. The nominal 20/2 yarns were creeled, made into six section beams and a portion was put on a loom beam containing 2544 ends. The remaining portion was placed on a similar loom beam of 2544 and sized with polyvinyl alcohol on a conventional slasher. The sized yarns on the loom beam were tied with a conventional tieing-in machine into an existing warp pattern on a shuttle loom. The unsized yarns were subsequently tied in the same manner as the sized yarns to the same warp pattern on the same shuttle loom.

Nominal 22/2 yarns prepared by the process of Example 1 and containing approximately 36% glass and 64% cotton were wound from a cone by the filling winder of the loom to a quill which is transferred to the shuttle during the weaving operation.

A plain weave canvas-type fabric, or nominal 8 oz/sq yd in weight with a construction of 63 ends and 48 picks was produced with the unsized warp yarns and the nominal 22/2 filling yarns. No problems were encountered in weaving. Weaver's knots were used to tie broken ends, such breaks were normal in frequency to that expected with weaving of conventional yarns, and knotted yarns created no additional problems in the weaving operation.

Warp properties of the fabrics were evaluated and results are given in the following table.

| | Warpwise Properties of Fabric | |
|---|---|---|
| Property | Sized | Unsized |
| Breaking Strength, lbs | 180 | 176 |
| Elong. at break, % | 28.9 | 29.8 |
| Elmendorf tear strength, g. | 4920 | 5050 |
| Stiffness, in.-lbs. | .0048 | .0032 |

These results demonstrate that yarns produced by the process of this invention may be knotted and woven into fabrics with no unusual problem and it is further shown that such yarns, when used as a warp, require no sizing agent prior to weaving.

EXAMPLE 4

Glass filament core, 100 denier, reinforced cotton yarns of nominal 22/2 cotton count were prepared by the process of Example 1 as filling yarns and woven into a plain canvas type fabric of nominal 8 oz/sq yd in weight as in Example 3. Yarns of 100% cotton of 22/2 and 16/2 cotton count were prepared following the same procedure but without the glass filament by spinning and plying. The 22/2 cotton filling yarn was woven into the same fabric structure as the nominal 22/2 glass filament core reinforced cotton yarns. The 16/2 cotton filling yarn was woven into a canvas-type fabric of 10 oz/sq yd in weight. Woven fabrics were then evaluated fillingwise and results are shown in the following table.

| | Fillingwise Properties | | |
|---|---|---|---|
| | Glass Filament Core | 100% Cotton | |
| Nominal Fabric Weight | 8 oz/sq yd | 8 oz/sq yd | 10 oz/sq yd |
| Nominal Filling | 22/2 | 22/2 | 16/2 |
| Brk str, lbs | 176 | 94 | 115 |
| Elong at brk, % | 11.0 | 14.6 | 16.1 |
| Elmendorf Tear Str, g. | 4300 | 1530 | 1830 |

The results demonstrate the large improvement in strength properties of fabric with glass filament core reinforced cotton yarns over equivalent cotton yarns.

We claim:

1. A process for producing knottable torque-free or balanced yarn comprising:

(a) feeding staple fiber roving through a drafting system to form a drafted strand of staple fiber;

(b) feeding glass filament yarn to the front rolls of the drafting system and placing the filament into the center of the drafted strand of staple fiber just prior to entering the front rolls;

(c) spinning the staple fiber around the glass filament core with a twist multiplier of from about 3.0 to 3.5 to assure proper adhesion of fiber to filament, and form a single yarn;

(d) ply twisting two or more of said single yarns in a direction opposite from the spinning direction to firmly lock the staple fiber wrap to the smooth filament glass core and thus produce a torque-free or balanced yarn.

2. The process of claim 1 including a step of guiding the glass filament yarn from a spool or bobbin to the front rolls of the drafting system and placing the filament into the center of the drafted strand of staple fiber just prior to entering the front rolls.

3. The process of claim 2 wherein the staple fiber is cotton.

4. The process of claim 3 including an additional step of condensing the staple fibers within the drafting system.

5. The process of claim 3 wherein the spun yarn has an actual cotton count of 18.9/1 and the yarn diameter is equivalent to 22/1 yarn spun from 100% cotton.

6. The process of claim 5 wherein the 22/1 spun yarn has a glass filament core ply twisted with 13.6 turns/inch of "Z" twist to produce a nominal 22/2 yarn that contained approximately 36% glass and 64% cotton.

7. The fiber wrapped filament glass core yarn produced by the process of claim 1.

8. The fiber wrapped filament glass core yarn produced by the process of claim 2.

9. The fiber wrapped filament glass core yarn produced by the process of claim 3.

* * * * *